United States Patent [19]

Graf

[11] Patent Number: 4,462,433

[45] Date of Patent: Jul. 31, 1984

[54] MECHANICAL WARP STOP MOTION APPARATUS

[75] Inventor: Martin Graf, Horgenberg, Switzerland

[73] Assignee: Grob & Co. Aktiengesellschaft, Horgen, Switzerland

[21] Appl. No.: 423,166

[22] Filed: Sep. 24, 1982

[30] Foreign Application Priority Data

Nov. 25, 1981 [DE] Fed. Rep. of Germany ..... 3146781

[51] Int. Cl.[3] ..... D03D 51/28

[52] U.S. Cl. ..... 139/358; 139/360; 139/369; 28/187; 66/163

[58] Field of Search ..... 139/349, 353, 358, 369, 139/360; 66/163; 28/187; 200/61.18

[56] References Cited

U.S. PATENT DOCUMENTS

| | | | |
|---|---|---|---|
| 2,479,546 | 8/1949 | Thatcher et al. | 139/358 |
| 4,367,771 | 1/1983 | Baumann | 139/358 |

FOREIGN PATENT DOCUMENTS

| | | | |
|---|---|---|---|
| 1760945 | 9/1972 | Fed. Rep. of Germany . | |
| 455791 | 3/1950 | Italy | 139/360 |
| 155421 | 9/1932 | Switzerland . | |
| 427686 | 7/1967 | Switzerland . | |
| 567127 | 9/1975 | Switzerland . | |

*Primary Examiner*—James Kee Chi

*Attorney, Agent, or Firm*—Watson, Cole, Grindle & Watson

[57] ABSTRACT

A warp stop motion apparatus includes individual disengageable coupling and control elements which have fork-like ends that are capable of surrounding the lateral sides of drive pins extending outwardly from the opposite sides of the end portions of the respective inner movable serrated bars which slidingly extend into a housing part that is oscillated back and forth by an individual electrical motor. Oscillation of the housing part causes the inner serrated bars to oscillate in their longitudinal direction with respect to outer stationary serrated bars in which they are positioned. Separate adjustable spring loaded locking cams act to keep each coupling and control element in position; however, if an inner serrated bar becomes blocked with respect to its movement relative to the associated outer serrated bar due to drop wire falling across the teeth thereof, the associated coupling and control element will rotate, causing a contact spring to close an electrical circuit which activates a switch to stop the weaving machine and the oscillating movement of the housing part.

7 Claims, 9 Drawing Figures

13
10
11
9
12
15
16
8
17
20
36
38,39
32
40
41
14
I
38
39
30
A
6
3
2
1
5
4

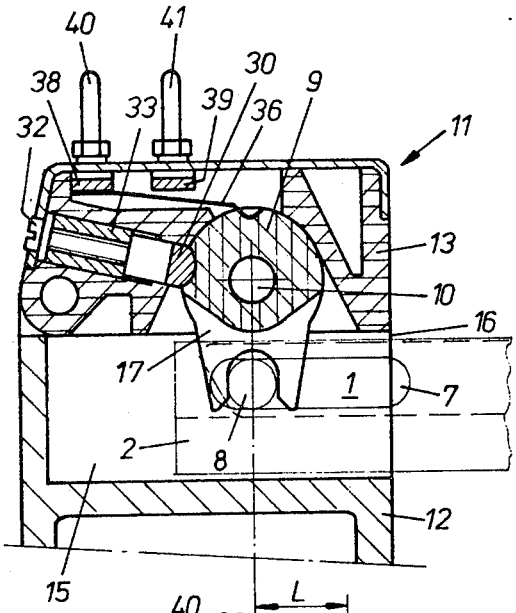
Fig. 6
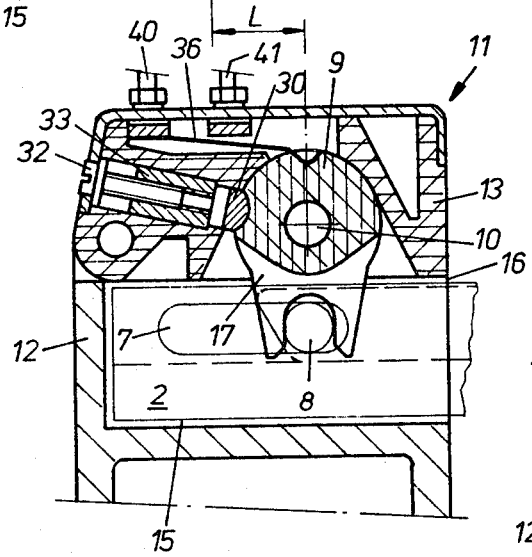
Fig. 7
Fig. 8
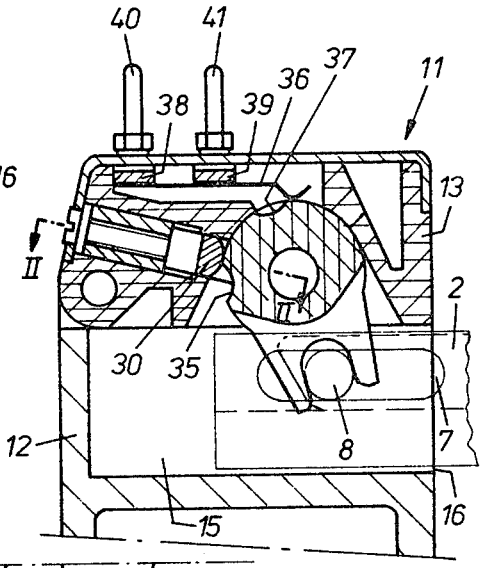
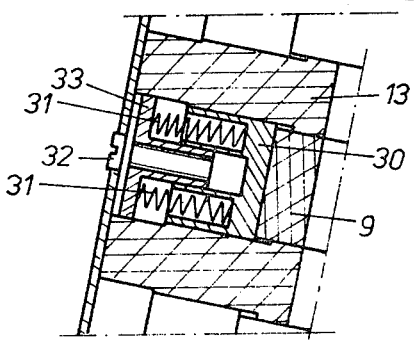
Fig. 9

MECHANICAL WARP STOP MOTION APPARATUS

BACKGROUND OF THE INVENTION

The present invention relates to a mechanical warp stop motion apparatus which acts to stop the operation of the associated weaving machine in case of warp end breakage, and more particularly to a mechanical warp stop device which utilizes multiple drop wire bars consisting of stationary outer serrated bars and movable inner serrated bars, the inner serrated bars being oscillated with respect to the associated outer serrated bars.

Due to lack of space, the large number of warp ends and the corresponding number of drop wires in a weaving machine cannot be arranged on one row. The drop wires therefore have to be arranged in several rows, running parallel to each other, and the parallel serrated bars of the associated mechanical warp stop motion device will be lined up therewith. As an example, with six serrated bars in the mechanical warp stop motion device, six rows of drop wires will also be used and each of these drop wires will, at the time of a warp end breakage, be capable of activating the mechanical warp stop motion device to in turn stop the weaving machine.

Existing warp stop motion devices of this nature, using for instance six serrated bars, utilize one common spring acting on all six serrated bars. The resisting force of this spring, which blocks the movement of one of the oscillating inner serrated bars and which has to be overcome in case of a warp end breakage and the subsequent falling of the drop wire, can be altered only by adjustment to that one spring. Due to the continuous drive which causes the oscillating movement, the spring, which co-operates with a coupling piece, will activate a contact, thus stopping the weaving machine. However, the resisting force of the spring has to be set relatively high so that the frictional force produced by the six serrated bars does not exceed the force of the spring, which otherwise will give false stoppages of the weaving machine. The pressure of the spring, on the other hand, has to be set stronger when the inner serrated bars are tightly fitted or when the dirt accumulation is heavy. The result of this is that the drop wires will get damaged or crushed on account of being pressed against the outer stationary serrated bar, and only after overcoming the pressure of the spring will the coupling piece discontinue driving the oscillating inner serrated bar and cause the weaving machine to be stopped. The drive is taken from a suitable mechanism which is part of the weaving machine.

It is an object of the present invention to provide a mechanical warp stop motion apparatus which will prevent the damage to the drop wires caused in the known prior art devices.

SUMMARY OF THE INVENTION

According to the present invention, each inner moving serrated bar is provided with a coupling and controlling mechanism which includes an associated spring whose resisting force can be kept comparatively low. Thus a comparatively low force on the inner serrated bar, resulting from a fallen drop wire, will activate the coupling and control mechanism such that the movement of the inner serrated bar will be discontinued and the weaving machine stopped. Damage to the fallen drop wire will therefore be avoided.

The invention allows for adjustment in the resistance force of each spring when the associated inner serrated bar is damaged and then replaced with a new one.

In addition, the blocking of one serrated bar does not necessitate that all other bars will also inevitably have to stop their motion, as is the case with already existing mechanical warp stop motion devices, i.e., a further advantage of the invention is, that the bars which are not blocked and not disengaged, can still make their oscillating movement, which can be used to facilitate location of the fallen drop wire. With the aid of a motor, which is part of the apparatus, these serrated bars can again be moved, and by this means the blocked serrated bar can easily be located.

For this purpose an individual drive for the apparatus is necessary. Mechanical warp stop motion devices in existence up to now have a drive which is activated from the weaving machine itself. Having stopped the weaving machine, the drive cannot be in operation as long as the warp end breakage is not repaired. The existing warp stop motion devices furthermore have a searching handle, which can be operated manually to move the serrated bar slightly in order to determine where the fallen drop wire is.

The separate drive motor of the inventive apparatus provides the constant oscillating movement to the serrated bars. Also, if the weaving machine is stopped, the oscillating movement for the searching process can still be carried out by momentarily switching on the individual drive motor.

Having adjoined to each serrated bar an individual coupling and controlling element, a further advantage of the present invention consists in the fact that in addition to the controlling process to stop the weaving machine, each of the serrated bars can be equipped with adjoining indicating devices which, in an optical or another appropriate measure, will indicate which of the individual serrated bars are blocked. Due to this, a fallen drop wire and the corresponding serrated bar can easily and quickly be determined, which considerably facilitates the finding of the broken warp end.

DESCRIPTION OF THE DRAWINGS

In the drawings,

FIGS. 6 and 7 show partial cross sectional side views of the housing part of the inventive warp stop motion apparatus as seen along line I—I in FIG. 3, showing two different relative positions of a coupling and controlling element in the housing part and the ends of the associated serrated bars which extend into the housing part, FIG. 8 shows a similar partial cross sectional side view of the housing part showing the relative position and orientation of a coupling and controlling element when the associated serrated bar has caused the element to be activated, and FIG. 9 shows a partial cross sectional side view of the housing part as seen along line II—II in FIG. 8.

DETAILED DESCRIPTION OF THE PREFERRED EMBODIMENT

Figure 1:
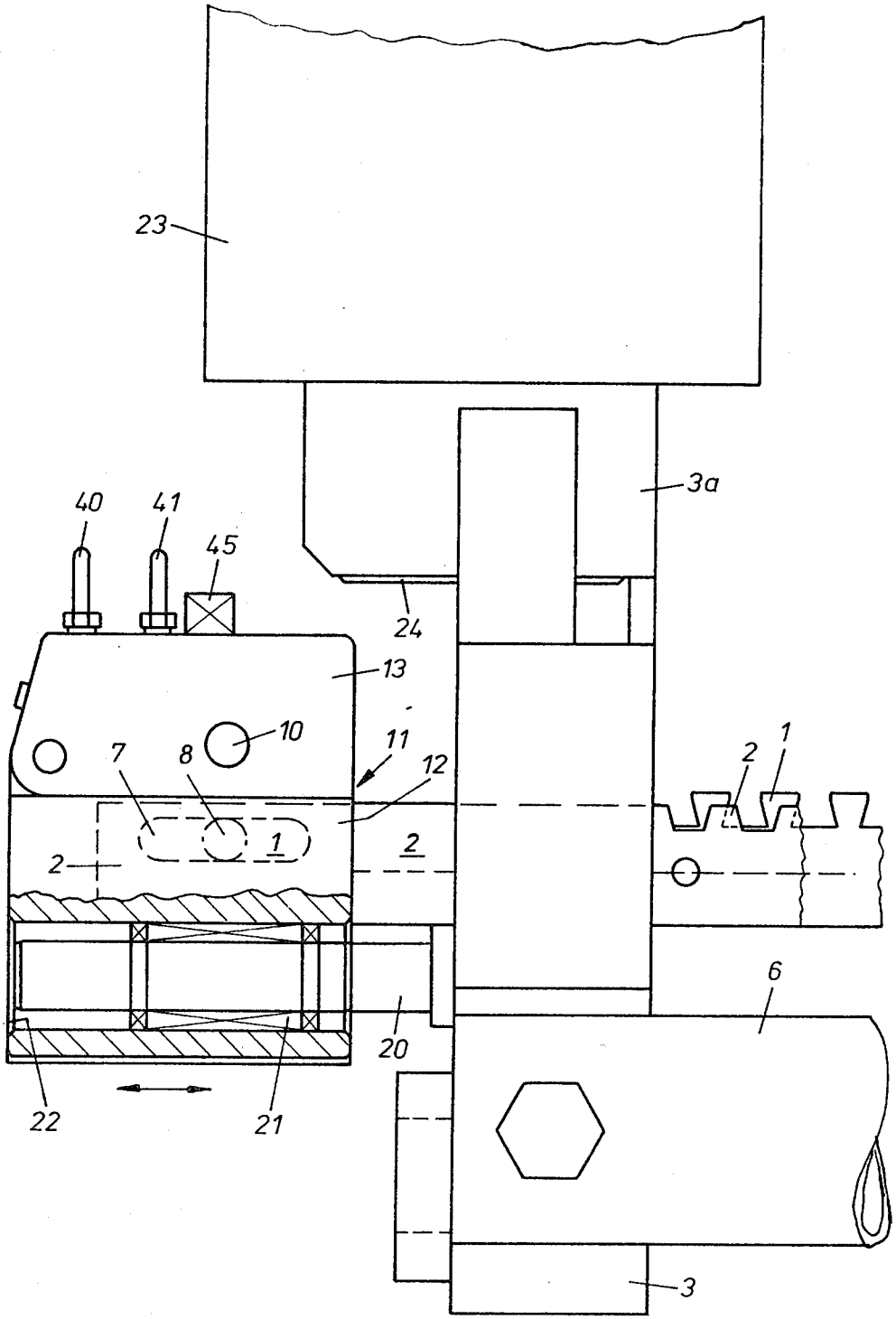
FIG. 1 shows a schematic side view of the driven end of a warp stop motion apparatus constructed according to the present invention.
Figure 2:
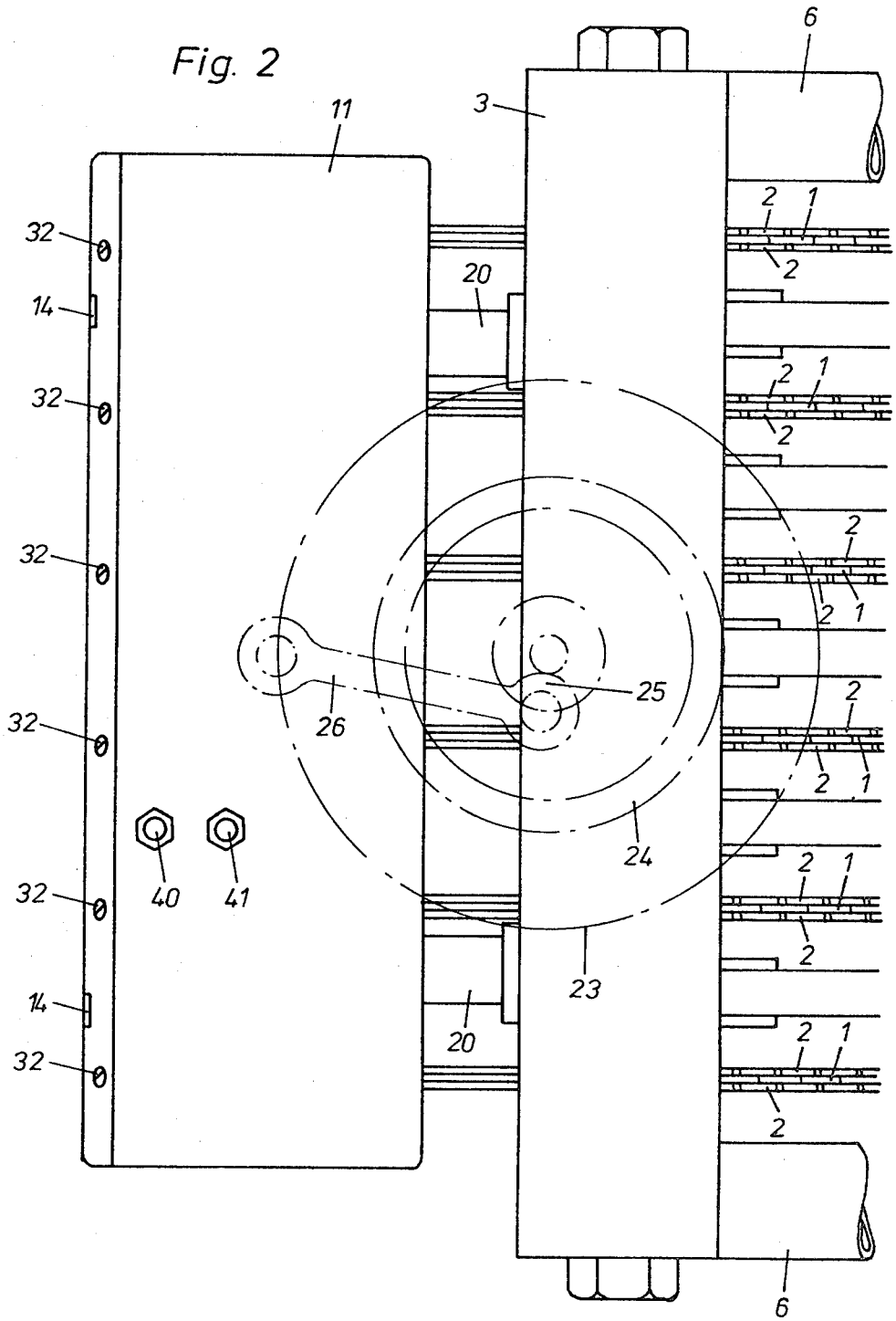
FIG. 2 shows a schematic top view of the driven end of the warp stop motion apparatus shown in FIG. 1.
Figures 3, 4, 5:
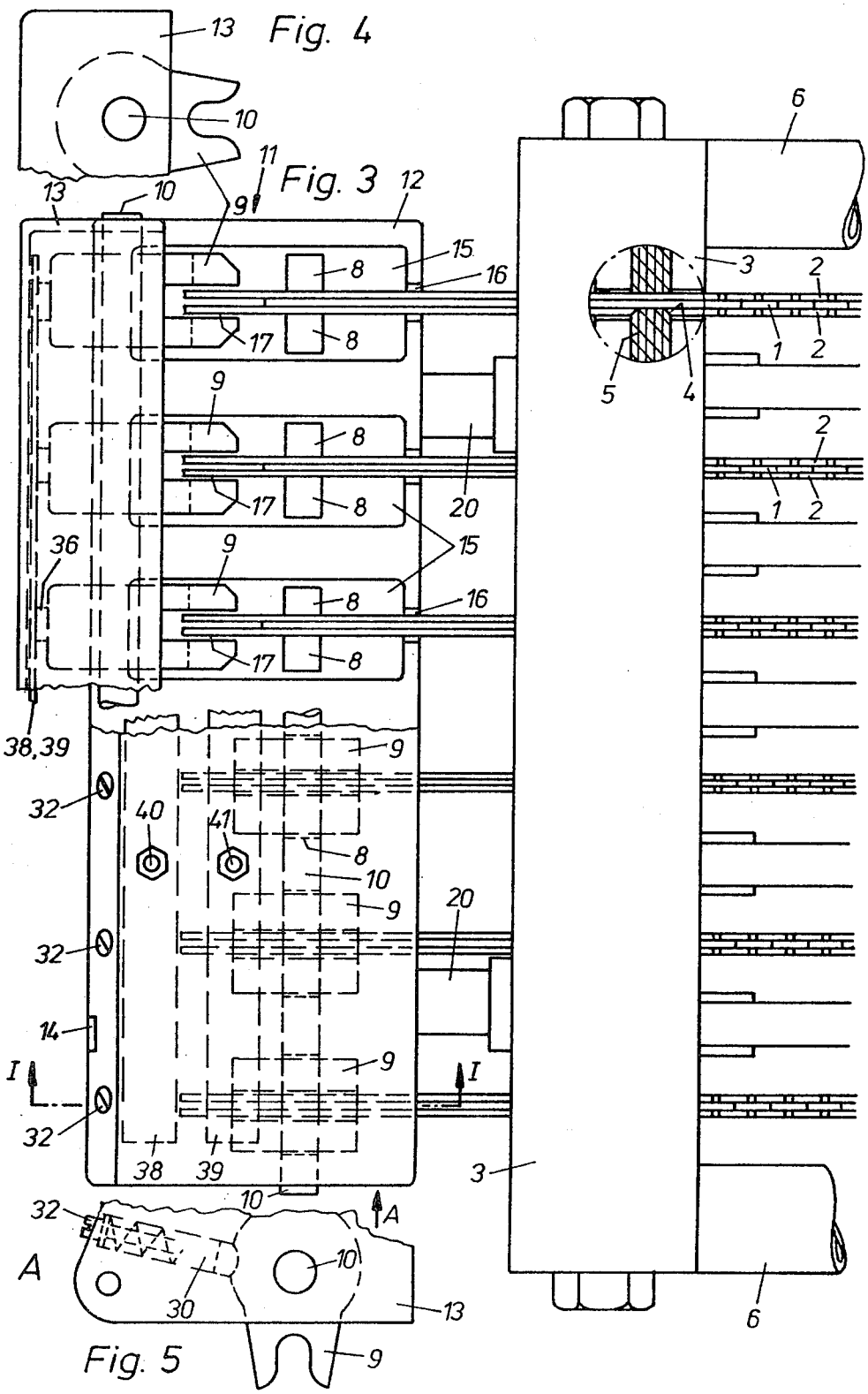
FIG. 3 shows an additional schematic top view of the driven end of the warp stop motion apparatus shown in FIG. 1, the portion of the figure showing the housing part of the apparatus indicating in its upper half the positioning of the cover portion thereof when opened with respect to the bottom portion and in its lower half the positioning of the cover portion when closed over the bottom portion.
FIG. 4 shows a schematic partial side view of the cover portion of the housing part of the inventive warp stop motion apparatus when oriented to its opened position.
FIG. 5 shows a partial schematic side view of the cover portion of the housing part of the inventive warp stop motion apparatus when oriented to its closed position.

FIGS. 1–3 show schematic views of the driven end of a mechanical warp stop motion apparatus constructed according to the present invention. The apparatus includes six movable inner serrated bars 1 and six stationary outer serrated bars 2, each inner serrated bar 1 being capable of moving (oscillating) in its longitudinal direction within an outer serrated bar 2. The outer serrated bars 2 are fixedly mounted by a bar support 3, which is perpendicularly oriented with respect to the longidutinal dimension of the outer serrated bars 2, so as to be in a parallel, side-by-side relation to one another and at the certain pitch. In this regard, as shown in the dash-dot circle detail in FIG. 3, each outer serrated bar 2 includes an inwardly angled notch 4 which extends upwardly along one of its sides to provide a seat for the suitably contoured end of a fixing element 5, which extends laterally therein to prevent movement of the associated outer serrated bar 2 in its longitudinal direction. Two supporting tubes 6 are respectively connected at their first ends to the opposite ends of the bar support 3 and at their second ends to another bar support (not shown) to provide a rigid framework.

Each outer serrated bar 2 includes a longitudinal slot 7 on each of its upwardly extending sides near its lefthand end (as seen in FIGS. 1–3), and each inner serrated bar 1 includes a driving bolt 8 extending outwardly from each of its lateral sides, the driving bolts 8 fitting within and being slidable along the respective longitudinal slots 7 of the associated outer serrated bar 2.

As can be seen from FIG. 3, the lefthand ends of each set of inner and outer serrated bars 1, 2 extend through a respective slot 16 in a housing part 11 and into a separate cell-shaped chamber 15 contained within the housing part. The housing part 11 is formed of a base portion 12 and a cover portion 13, the cover portion 13 being connected to the base portion 12 by two spaced apart hinges 14 so as to enable the cover portion to be opened up or closed with respect to the bottom portion as desired (it is opened up in the upper half of FIG. 3 and closed in the lower half). Each slot 16 is actually formed in the base portion 12 such that the lefthand ends of the inner and outer serrated bars 1, 2 are contained in the portion of each chamber 15 located in the base portion of the housing part (see FIGS. 6–8). A common axle 10 which extends through the cover portion 13 mounts six rotatable coupling and controlling elements 9, each element 9 being contained in a separate chamber 15. Each element 9 includes a fork-shaped end which extends away from the axle 10, as well as an inwardly extending slot 17. The slot 17 of each element 9 is dimensioned so as to allow the upper edges of the associated inner and outer serrated bars 1, 2 to extend therein when the cover portion 13 is in its closed position, while the fingers of each fork-shaped end are shaped to encompass the opposite sides of the two driving bolts of the associated inner bar 1 which extend outwardly beyond the upwardly extending sides of each associated outer serrated bar 2.

The oscillation of the inner serrated bars 1 with respect to their associated outer serrated bars 2 is accomplished by moving (oscillating) the housing part 11 back and forth with respect to the bar support 3, thus causing, via the elements 9, the inner serrated bars 1 to move in their longitudinal dimenstion with respect to the outer serrated bars 2, which are themselves stationarily mounted on the bar support 3. In this regard, the housing part 11 includes two bores 22 in its base portion 12 (below the cavities 15), and extending with each respective bore 22 in a guide rod 20 which is fixed to the bar support 3. Roller bearings in a bush 21 in each bore 22 enable the housing to be easily moved back and forth along the guide rods 20. In addition, an electrical motor 23 is mounted on a cover **3*a* on the bar support 3, and via a gear 24 (the gear shaft is not shown) drives a cam 25 which, via a connecting rod 26, results in the back and forth oscillation of the housing part 11 (see FIG. 2). The connecting rod 26 is connected to the housing part 11 at a point between the bores 22** and level therewith.

The details of each control structure which cooperates with each coupling and control element 9 in the cover portion 13 of housing 11 is shown in FIGS. 6–9. As seen in FIGS. 6–7 it can be seen that each coupling and control element 9 is kept in position by a spring-loaded locking cam 30 which engages in a notch 35 in the element 9 which extends parallel with the axle 10 so as to deter rotation of the element 9 with respect to the axle 10. Thus the fork-shaped end of each element 9 will engage the driving pins 8 of each associated inner serrated bar 1 and, as the housing part 11 is caused to oscillate back and forth with respect to the bar support 3, cause the inner serrated bar 1 to correspondingly move in its longitudinal direction and thus oscillate with respect to its associated outer serrated bar 2. More specifically, and as seen in FIG. 9, each locking cam 30 is backed by two pressure springs 31 which are respectively located at the opposite sides of the locking cam and are mounted on a screw socket 33 which is adjustably positioned with respect to the rear of the housing part 11 by an adjusting screw 32. By rotational movement of the adjusting screw 32, the pressure applied to the locking cam 30 in the direction of the associated element 9 (and thus the force needed to push the locking cam out of engagement with the notch 35) can be changed. As indicated in FIGS. 6 and 7, the element 9 is normally moved a distance L by the oscillation on the housing 11. This movement of the elements 9 will cause the driving pins 8 of each associated inner serrated bar 1 to move a corresponding distance within the longitudinal slots 7 of each associated outer serrated bar 2, i.e., from first ends of the slots to the opposite ends, and consequently the inner serrated bar will move the same distance in its longitudinal direction.

Referring to FIG. 8, the swivelled condition of one of the elements 9 is shown which occurs when the housing 11 is moving away from the support bar 3 (from the position shown in FIG. 7 to the position shown in FIG. 6), but wherein the movement of the associated inner serrated bar 1 has become jammed with respect to its associated outer serrated bar 2 due to a fallen drop wire having fallen between the teeth of the bars. As the element 9 is forced to swivel about axle 10 due to jamming of the inner serrated bar 1, the free end of a contact spring 36 is caused to disengage from a notch 37 in the periphery of the element 9 and move upwardly to contact the contact strip 39 which is connected to an electrical pin 41. Since the fixed end of the contact spring 36 is connected to the contact strip 38 which is connected to the electrical pin 40, the circuit between the electrical pin 41 and the electrical pin 40 will be closed. The two electrical pins 40 and 41 can in turn be connected by a suitable cable to a control relay for the weaving machine with which the inventive arrangement is used, i.e., so as to stop its operation when the electrical circuit between the electrical pins inside the housing 11 has been closed. The contact strips 38, 39 extend across the cover portion of the housing part such that the swivelling of any of the elements 9 will close the electrical circuit between the pins 40, 41.

Each of the elements 9 is allowed to swivel about axle 10 sufficiently that its forked end can completely disengage from the driving pins 8 of the associated inner serrated bar 1, yet automatically re-engage therewith when the relative movement therebetween is reversed. This may happen after the weaving machine and the drive motor 23 have been stopped, due to a fallen drop wire, and the drive motor 23 is subsequently started again to facilitate location of the broken warp end. The fallen drop wire will receive some blows, the strength of which depends on the still-achievable oscillating movement of the inner serrated bars 1, this being based on the width of the gap between the serrated teeth thereon and the amount of swivelling of the associated element 9. The extent of the stress acting on the drop wire is small, however, since the pressure of the springs 31 of the six spring pairs used in total is small compared to the single spring used in prior known mechanical warp stop arrangements.

Because each individual element 9 is independently rotatable, individual indicating devices 45 can be used therewith to indicate, either optically or electrically, which of the various elements 9 are associated with blocked inner serrated bars 1. This enables immediate determination of where the fallen drop wire is positioned in the weaving machine.

Although a specific embodiment of the present invention has been disclosed in detail, it will be obvious that various modifications therein can be made yet still fall within the scope of the appended claims.

I claim:

1. A mechanical warp stop motion apparatus which includes a multiplicity of spaced apart outer serrated bars which are stationarily mounted to be parallel, side-by-side relationship; a multiplicity of inner serrated bars, each inner serrated bar being movable in its longitudinal direction within an outer serrated bar; and means to move each inner serrated bar with respect to its associated outer serrated bar and to detect when any of the inner serrated bars are prevented from movement with respect to its associated outer serrated bar by a drop wire falling across the serrations of the bars, said movement and detection means including a housing into which an end portion of each inner serrated bar extends, drive means connected to the housing to move it back and forth in the longitudinal direction of the inner serrated bars, and multiplicity of coupling and control elements located in the housing, a separate coupling and control element being attachable and disengagable from the end of each inner serrated bar located in the housing, and separate means in the housing in contact with each coupling and control element to determine if it has become at least partially disengaged from the end of its associated inner serrated bar due to blockage of movement of the inner serrated bar due to a drop wire falling across the associated inner and outer serrated bars.

2. The device as defined in claim 1 wherein each coupling and control element is rotatable about a common axle which extends through the housing and wherein the movement and detection means also includes separate adjustable spring-loaded locking cams which contact the periphery of the respective coupling and control elements to deter disengagement of each coupling and control element from its associated inner serrated bar.

3. The device as defined in claim 2 wherein an end portion of each outer serrated bar extends into the housing, the end portion of each outer serrated bar located in the housing including longitudinal slots, wherein each inner serrated bar includes drive bolts which extend outwardly from its sides to slidingly extend through and outwardly from the longitudinal slots in the associated outer serrated bar, wherein each coupling and control element includes a fork-like end which is capable of surrounding the sides of the drive bolts on the associated inner serrated bar.

4. The device as defined in claim 3 wherein each coupling and control element includes a first notch in its periphery in which the associated adjustable spring-loaded locking cam fits.

5. The device as defined in claim 4 wherein each coupling and control element includes a second notch in its periphery, wherein two electrical pins are connected through the housing, wherein electrical contact strips respectively in contact with the two electrical pins extend across the housing, wherein adjacent each coupling and control element is a contact spring, one end of each contact spring being connected to one of the electrical contact strips and the second end being positioned in the second notch of the associated coupling and control element when the fork-like end of the coupling and control element is symmetrically positioned around the lateral sides of drive bolts of the associated inner serrated bar, each contact spring being moved into contact with the other electrical contact strip when the associated coupling and contact element is caused to rotate about the axle sufficiently that the second end of the contact spring is dislocated from the second notch therein.

6. The device as defined in claim 5 wherein a separate indicator means is electrically connected to each coupling and control element to indicate whether its associated inner serrated bar has been blocked from movement with respect to its associated outer serrated bar.

7. The device as defined in claim 5 including a support bar which fixedly supports all the outer serrated bars.

* * * * *